United States Patent [19]

Lowell

[11] 4,233,497

[45] Nov. 11, 1980

[54] ELECTRIC HEATING ELEMENT

[76] Inventor: Herman H. Lowell, 2808 Harris Ave., Wheaton, Md. 20902

[21] Appl. No.: 966,214

[22] Filed: Dec. 4, 1978

[51] Int. Cl.[3] ..... H05B 3/00

[52] U.S. Cl. ..... 219/468; 219/553; 338/217

[58] Field of Search ..... 338/217, 218, 333; 219/552, 553, 547, 468

[56] References Cited

U.S. PATENT DOCUMENTS

| | | | |
|---|---|---|---|
| 535,321 | 3/1895 | Delany | 338/217 |
| 2,689,803 | 9/1954 | Ackerman | 338/217 |
| 3,851,150 | 11/1974 | Van Holzen | 219/553 |

FOREIGN PATENT DOCUMENTS

| | | | |
|---|---|---|---|
| 361960 | 11/1931 | United Kingdom | 219/468 |

*Primary Examiner*—B. A. Reynolds
*Assistant Examiner*—Bernard Roskoski
*Attorney, Agent, or Firm*—Dennison, Dennison, Meserole & Pollack

[57] ABSTRACT

An electric heating element for a cooking apparatus or other device requiring uniform heat generation over an extended area is presented in which the thickness (T) of the electrically resistive heating element increases from the outer edges of the generally disc-shaped element towards the center in inverse proportion to the square of the ratio of the radius (r) at any point to that of the radius at a reference point ("a"), so that $$T = T_a \frac{r_a^2}{r^2}.$$

Heating elements fabricated with cross sectional shapes calculated in accordance with the parameters set forth above and disclosed in detail herein and in which the current flow is radial, provide uniform energy release and therefore nearly uniform heat across the surface of the element. Additionally, the absolute element dimensions and masses per unit surface area are small, maximizing rates of desired temperature setting changes. The basic principle is applicable in several technologies related to cooking, e.g., vacuum evaporation.

19 Claims, 6 Drawing Figures

ELECTRIC HEATING ELEMENT

THE INVENTION

This invention relates to an electrical heating element for an electric stove, hot plate, frying pan or similar electrically heated cooking appliance or other device requiring uniform energy release over an extended area. The basic principle is applicable in several technologies, e.g., vacuum evaporation.

BACKGROUND OF THE INVENTION

Modern technology has produced a wide variety of electrical heating devices for use in cooking appliances. One class of electrical heating device which has been popular since the advent of readily available and economical electrical power has been the resistive electrical heating element.

Resistive electrical heating elements have been fabricated in a plurality of shapes over the years in an attempt to achieve the ideal heating element which is an element which will provide a flat surface having a uniform heat characteristic without exhibiting a gradient phenomenon or hot spots. This ideal heating element has been approached in electrical resistive heating but never actually accomplished in cooking appliances. For instance, E. Grahm in U.S. Pat. No. 3,798,415 on "Electrically Heated Cooking Utensil" issued Mar. 19, 1974, discloses the concept of a heating element which includes a heat transfer sink having a varying dimension calculated to shorten cooking time by increasing the heat conduction from the peripheral elements to the center of the appliance. This crudely approaches the concept of a uniform heat surface but the actual resistive heating elements are located in predetermined areas beneath the cooking surface and therefore a heat gradient will always exist across the cooking surface and hot spots in the areas of the resistive elements will occur.

D. Harris in U.S. Pat. Nos. 3,351,742 and 3,383,497 on "Electrical Resistance Heaters" issued Nov. 7, 1967 and May 14, 1968 teaches the concept in a graphite heating element of providing a graded thickness to the element so that the electrical resistance characteristics of the heater will be uniform and a roughly uniform heat will be produced across the surface of the element. A plurality of holes are drilled through the Harris heating element to ensure that approximately uniform heat distribution is achieved. Incorporating the plurality of holes, in the heating element of Harris, causes heat flow variations which are chosen experimentally to cause the heating element to approach a constant temperature surface, however the heat transfer characteristics created by the holes drilled in the element result in undesired variations in the surface temperature and thus the ultimate goal of a uniform temperature surface has been approached but not achieved. Hole distribution is wholly empirical and rests on no theoretical base.

L. Orr in U.S. Pat. No. 2,569,773 on "Electroconductive Article" issued Oct. 2, 1951, discloses the concept of providing an electrode having a varying thickness so that heat generated by the electrode is approximately uniform across the electrode surface, see for instance FIG. 5. Orr teaches the concept of a sprayed-on electrode on a window; the heat generated is utilized to defrost or deice a windshield. The concept, involving low energy input rates, is not applicable to cooking elements. Current flow is non-radial.

E. Thompson, U.S. Pat. No. 1,072,503 on "Electric Heater" issued Sept. 9, 1913, is a very early attempt to achieve predetermined heat characteristics by utilizing a heat transfer medium which is configured in varying thicknesses calculated to cause the actual heat transfer from an electrical resistive heating element to be conducted to a surface and radiated therefrom in an approximate uniform fashion. This concept is similar in basic principle to the heat transfer medium concept presented in Grahm previously discussed.

The concept of a tapered or varying thickness heat transfer medium is also incorporated in the E. Wolcott U.S. Pat. No. 1,485,153 on "Electric Heater" issued Feb. 26, 1924. In this embodiment, as in all other embodiments suggested, a significant drawback exists in that a special heat transfer means must be incorporated in the heating element and the uniform heat transfer of the device is only roughly approached. Variations in individual heaters cannot be accommodated by a mass produced heat transfer element and the market will not bear the added cost required to individually tailor each heat transfer element to match the characteristics of its associated resisting heating element. Again, there is no firm theoretical design foundation.

W. Hadaway Jr., U.S. Pat. No. 563,032 on "Electric Heater" issued June 30, 1896, is a very early example of an attempt to create a uniform heating surface in a cooking utensil. This device uses a spiral of coils having a decreasing diameter as the overall electrode spirals towards the center of the heating element. This approach results in a spirally shaped hot spot which decreases in temperature variation as the center of the element is approached and thus the goal of a uniform heating surface without hot spots or gradient is not achieved. The element is awkward, massive, and complex, with no quantitative design basis.

OBJECTIVES OF THE INVENTION

In view of the obvious inability of the prior art electric heating systems to provide a uniformly heated element surface, it is a primary objective of the present invention to provide an electrical heating element having a simple yet theoretically correct electric resistance variation which, with a radial current flow, will result in a basically uniform heat distribution throughout.

Another objective of the present invention is to provide an electrical heating element which has a thickness that varies inversely with the square of the ratio of the radius at any point to the radius at a reference point.

A still further objective of the present invention is to provide an electrical heating element which will offer a cooking or other energy-release surface and provide uniform heat across the cooking or other surface void of hot spots or significant temperature gradients.

A further objective of the present invention is to provide an electric heating element which is economical to produce and maintain.

A still further objective of the present invention is to provide an electrical heating element which is dimensioned to provide predetermined relative heat zones on a cooking surface through precisely calculated deviations from the basic inverse square law.

A still further objective of the present invention is to provide an electrical heating element having a small dimension normal to the principal plane, and therefore, a small mass per unit area in that plane, so as to greatly increase rates of change to desired new temperature settings.

The foregoing and other objectives of the invention will become apparent in light of the drawings, specification and claims contained herein.

SUMMARY OF THE INVENTION

Presented hereby is an electrical resistance heating element for use in a cooking or other appliance characterized in that it has a thickness which varies inversely with the square of the ratio of the radius at any point to the radius at a reference point whereby the electrical resistance and radial current magnitude vary in such a way as to automatically ensure uniform generation of heat throughout, resulting in temperature uniformity save at the periphery and over a small central hole of the plane surface offered by the element. The invention also contemplates creating cooking or other element electrodes having various cross sectional areas precisely calculated to provide predetermined relative heat zones over an energy-release plane.

DESCRIPTION OF THE INVENTION

Figure 1:
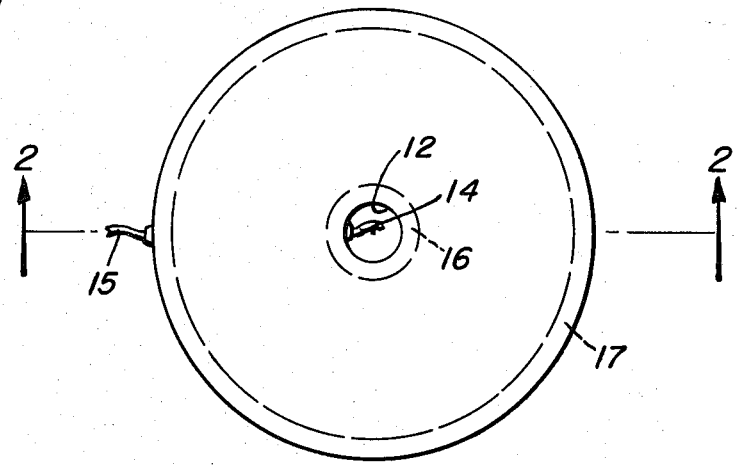
FIG. 1 is a top view of an electrical resistive heater constructed in accordance with the principles disclosed herein and adapted for use in a hot plate or comparable unit.
Figure 2:
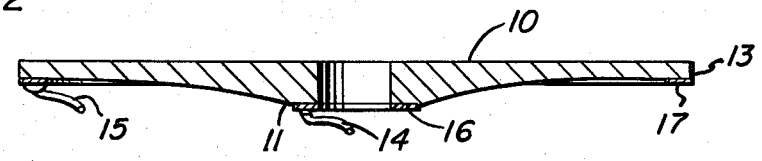
FIG. 2 is a cross sectional view taken along the line 2—2 of FIG. 1 illustrating the variable thickness of the element. The thickness is, relatively, greatly magnified as compared with other dimensions.

The invention presented hereby may best be visualized by considering FIG. 1, which illustrates a top view of a very simple embodiment of the invention, in combination with FIG. 2 depicting a cross sectional view of the embodiment taken along the line 2—2.

The heating element has a flat upper surface 10, which will generally be coated with an insulating oxide so that a cooking utensil may be placed directly thereon, and a central bore 12. The underside of the element incorporates a ridge or thickening 11 about the central bore 12 and a ridge or other thickening 13 about the outer periphery. Ridges 11 and 13 may be of more highly electrically conductive material and may structurally reinforce the element and form flat circular surfaces on the underside to which circular electrodes 16 and 17, of second or third materials, are secured. The electrodes are electrically connected across the total flat surface of the ridges and provide uniform electrical distribution about the outer periphery and the central bore of the element. The circular electrodes 16 and 17 on ridges 11 and 13 function as connection points for electrical connectors 14 and 15 which connect the heating element to a source of electrical power. Because of the uniform current flow about ridges 11 and 13, current flow therebetween assumes a radial current path which may be characterized as following an infinite number of radii between the center of the element and outer periphery. Ridge 11 and/or electrode 16 may, alternatively, consist of hole-less cylinders occupying the central element bore volume.

The element may be fabricated from nichrome, ceramic-metal combinations or any of a large number of resistive conductors which generate heat in response to current flow therethrough. A large variety of fabrication techniques may be used, for instance, the element may be cast, drawn, vacuum deposited, sputtered, electroplated, or pressed. The circular electrodes 16 and 17 on ridges 11 and 13 and the oxide insulating coating on those surfaces requiring electrical insulation may be applied by some combination of vacuum deposition, sputtering, electroplating or dipping or similar techniques.

The thickness of the element as illustrated in FIG. 2 varies along the radius of the heating element in accordance with the formula $$T = T_a \frac{r_a^2}{r^2}$$

where T is the thickness of the element and r is the radius, where $T_a$ and $r_a$ are as measured at any convenient reference point.

The foregoing thickness calculation is based on the fact that the (radial) resistance of a complete annulus may be described as having a differential resistance dR:

$$dR = \frac{\rho dr}{2\pi r T}$$

where $\rho$=resistivity.

The total resistance between radii $r_1$ and $r_2$ is then given by the integral $$R = \int_{r_1}^{r_2} \frac{\rho dr}{2\pi r T} = \frac{\rho}{2\pi} \int_{r_1}^{r_2} \frac{dr}{rT}.$$

This relation is quite general. Under the present invention, however, it is assumed that $$T = T_a \frac{r_a^2}{r^2}$$

as above, from which $$dR = \frac{\rho dr\, r^2}{2\pi r \cdot T_a r_a^2} = \frac{\rho r dr}{2\pi T_a r_a^2}.$$

This leads to $$R = \frac{\rho}{2\pi T_{r_a^2}} \int_{r_1}^{r_2} r dr = \frac{\rho}{4\pi T_a r_a^2} (r_2^2 - r_1^2)$$

when the inverse square law of thickness variation is precisely followed.

Since the total power W dissipated by the element is $I^2R$, between $r_1$ and $r_2$, $$W = I^2 \frac{\rho}{4\pi T_a r_a^2}(r_2^2 - r_1^2),$$ where I is the total current, where I is the total current,
and the power q released per unit element surface is $$q = \frac{W}{\pi(r_2^2 - r_1^2)} = \frac{I^2\rho(r_2^2 - r_1^2)}{4\pi^2 T_a r_a^2(r_2^2 - r_1^2)} = \frac{I^2\rho}{4\pi^2 T_a r_a^2}$$

which is constant over the entire active element area. Obvious modifications are readily made when the element is no longer a simple disc; modifications are described in the following and are easily reflected in the theory.

Further, the preceding theory may be utilized as given or as easily modified to calculate the desired thickness variations required to produce predetermined quantities of heat at varied distances from the center from resistive materials of known resistivity.

Figure 3:
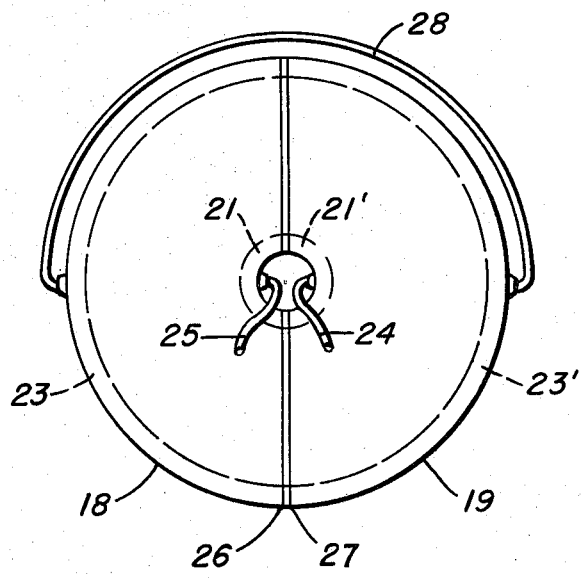
FIG. 3 illustrates an alternative embodiment wherein the electrode is comprised of two sectors of a circle.

Since the calculations are based on an infinite number of radii, the invention may be practiced by using heating elements comprised of a plurality of segments. For instance, FIG. 3 illustrates a heating element of varying thickness similar to that illustrated in FIG. 2 and described by the preceding formulation wherein the element is divided into two half circular sections 18 and 19. Both sections incorporate electrodes 21 and 23 which serve the same purpose as described for electrodes 16 and 17 in FIGS. 1 and 2.

In the embodiment of FIG. 3, the mating surfaces of the segments 18 and 19 are provided with an insulating oxide 26 and 27 which prevents the two segments from shorting together and destroying the radial current flow. Current flows along adjacent sector boundaries are in opposite directions. In this embodiment electrical connections are made via connecting wires 24 and 25 to the inner electrodes 21 and 21' of segments 18 and 19. The outer electrodes 23 and 23' are electrically connected by a jumper 28. Alternately, in place of jumper 28, the outer electrodes 23 and 23' may be electrically connected through conductive pads which are not coated by the oxide insulation 26 and 27 at the interface of the two segments. With this more simple arrangement, however, precisely uniform radial current flow will be made difficult to achieve.

Figure 4:
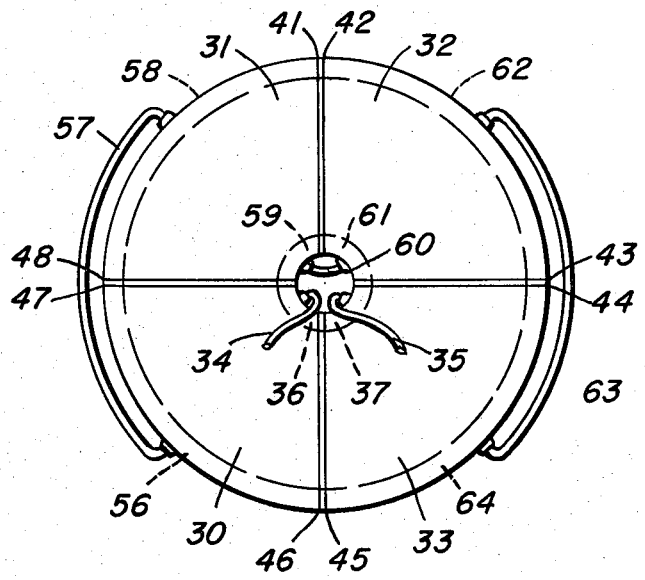
FIG. 4 is another alternate embodiment of the present invention wherein an even number of equal sectors of similar configuration form the heating surface.

FIG. 4 is another adaptation of the present invention wherein a number of uniform segments form a complete circle. It should be realized that if a wedge-shaped burner is desired, only one segment of any of the embodiments may be employed using the electrical interconnection of FIG. 1. However, in FIG. 4 the circular burner is divided into four segments and all four are utilized. The electrical power connections 34 and 35 are connected to inner ridge conductor segments 36 and 37 and all four segments are isolated from each other by an insulating coating on their adjoining interfaces 41 thru 48. Current flow in the embodiment in FIG. 4 is between conductor 34 through ridge electrode 36 and the associated segment 30 and its peripheral segment electrode 56. This electrode is connected by a jumper 57 to the peripheral electrode 58 of segment 31. The inner electrode 59 of segment 31 is connected to the inner electrode 61 of segment 32 by a jumper 60 to continue the path of current flow into segment 32 which is coupled via its peripheral electrode 62 and jumper 63 to the peripheral electrode 64 of segment 33.

If desired, jumper wires may be eliminated from the embodiment of FIG. 4 and uninsulated pads may be located at the peripheral electrode position between segments 30 and 31 and 32 and 33 with uninsulated pads between the inner electrodes 59 and 61 of segments 31 and 32.

Figure 5:
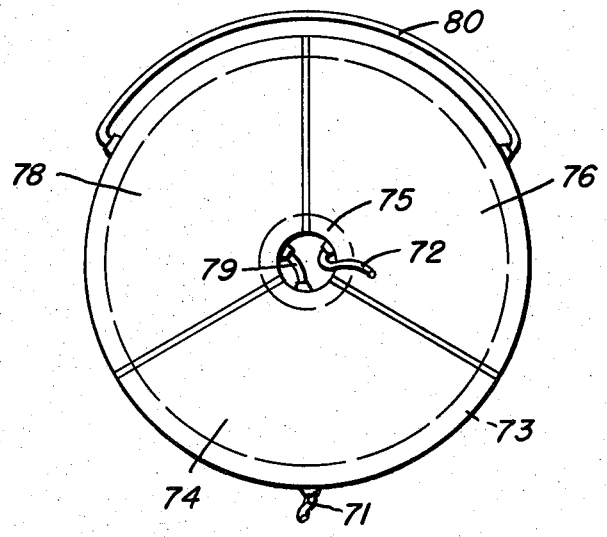
FIG. 5 is a schematic diagram illustrating a nonconcentric lead configuration for electric heating elements fabricated in accordance with the invention presented hereby.

An odd number of segments may be incorporated to provide a circular or semicircular heating element. FIG. 5 is a typical example of an interconnection which may be utilized in this type of configuration. In FIG. 5 power is applied to the segments via conductors 71 and 72 with conductor 71 connected to the peripheral ridge connector 73 of segment 74 and connector 72 connected to the inner conductor 75 of segment 76. The three segments, 74, 76 and 78 of FIG. 5 are insulated from each other by oxides or similar insulating coatings as described for the embodiments of FIGS. 3 and 4. A path for current between conductors 71 and 72 may be traced thru segment 74 and jumper 79 to segment 78 and then thru jumper 80 to segment 76 and the other power lead 72. In this embodiment as in the other multi-segment embodiments, jumpers 79 and 80 are presented as being illustrative of means to interconnect the segments but they may be replaced by conductive pads or similar structures obvious to those skilled in the art.

All of the embodiments illustrated in FIGS. 1, 3, 4 and 5 or adaptations thereof may utilize a single cross section similar to that illustrated in FIG. 2 with a thickness calculated by the identity $$T = T_a \frac{r_a^2}{r^2}.$$

Figure 6:
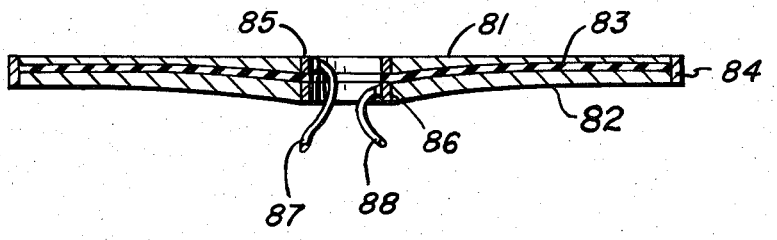
FIG. 6 is a cross sectional view of an alternate embodiment of the present invention illustrating a folded electrode approach.

However, an alternate construction may be utilized such as that illustrated in FIG. 6. In FIG. 6 the resistive element comprises an upper section 81 and a lower section 82 with the thickness of each section calculated by the equation $$T = T_a \frac{r_a^2}{r^2}.$$

$T_a$ may however, vary between layers but will usually be the same for each layer and be smaller than for the single layer disc. Sections 81 and 82 are separated by an insulating layer 83 which may be a thin refractory oxide coating or other insulator, preferably of high thermal conductivity. In this configuration ridges for supporting conductive rings such as 16 and 17 of FIGS. 1 and 2 are not required. Instead, a conductive band 84 is provided about the periphery of the element to electrically bond their edges and conductive rings 85 and 86 are bonded to the inner bore of the element. Conductive rings 85 and 86 are insulated from each other by the same material utilized to form the insulating layer 83 so that each ring may serve as a connecting point for a power connector 87 and 88 to create an obvious path of current between rings 85 and 86 thru the upper segment 81, peripheral conductive band 84 and the lower section 82. Ring 85 may be replaced by a bore-less cylinder.

The total resistance of the complete electrical path of FIG. 6, when the total thickness of the two layers at any radius equals the thickness of the single layer of FIGS. 1 thru 5, is exactly four (4) times the resistance of the single layer-element. This is highly advantageous, since it can be shown that the higher resistance is associated with current levels and required driving voltages more nearly commensurate with standard electrical element practice than are the corresponding parameters of the single-layer embodiments of FIGS. 1 thru 5. The principles of FIG. 6 can be of course extended to multiple layers at the usual cost of complexity, but with a further gain in electrical resistance at the same overall element thickness with corresponding and generally beneficial changes in required voltage and current levels for elements at, say, the 600 to 1,000 watt level. For n layers, all in series, where the thickness of each layer is 1/n'th the thickness of the simple single-layer active element, the overall resistance is $n^2$ as great as that of the single layer. For the same wattage, the n-layer current is 1/n'th that of the single-layer, and the required driving voltage is then n times that of the single-layer element, all other factors remaining the same.

The construction illustrated in FIG. 6 may be used to form complete circular elements or segments of elements in the same fashion as the structure illustrated in FIG. 2. It is further contemplated that differential heat zones may be created utilizing the principles set forth herein. This may be accomplished by varying the geometry of the sections while maintaining their basic radial properties within areas at which uniform temperature is a requirement. The basic radial properties that must be maintained are that the electrodes on the surface of the section exhibit arcuate facing edges dimensioned so that they form sectors of circles having a common center and all sectors, in the usual case, may be defined as having equal interior angles at the center. The electrodes must be positioned so that the closest point between electrodes is at radially opposed points to create a wedge-shaped section between electrodes. This geometry results in electrodes having related lengths wherein the length of the largest electrode is equal to the length of the shortest electrode multiplied by the ratio of electrode radii.

The absolute values of total electrical resistance of element configurations corresponding to FIGS. 1 thru 5 or even of FIG. 6, with variations, tend to be small despite use of rather small element average thicknesses for conventional materials—for example, nichrome. As described, the FIG. 6 embodiment, while providing a superior electrode and power connector geometry, still requires active element mean thickness, for common materials such as nichrome, commensurate with manufacturing processes consisting, for example, of combinations of evaporation, sputtering, and electroplating rather than conventional drawing, stamping, etc. Embodiments of the invention, using such processes, might well be implemented with materials, such as semiconductors or ceramic-metals, having much higher resistivities than nichrome or other conventional element alloys. It is accordingly contemplated that such materials and processes will be used in some embodiments, to achieve the small areal unit masses that are a principle feature of the invention while achieving driving voltages and currents comparable with those of conventional elements, if desired.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. An electric heating element, comprising:

a resistive electrical conductor geometrically configured about a central point and having uniform resistivity;

said conductor including radial dimensions in a first plane including said central point;

said conductor including a varying thickness perpendicular to said first plane; and wherein said thickness of said conductor at a given radius from said central point varies inversely with the square of the ratio of said given radius to a reference radius, at a reference point within said radial dimensions of said conductor.

2. An electrical heating element as defined in claim 1, further comprising:

a first electrode at a first radius from said central point and electrically connected to said resistive electrical conductor; and a second electrode at a second radius from said central point and electrically connected to said resistive electrical conductor, said second electrode having a length substantially equal to the length of said first electrode times the ratio of said second radius to said first radius, and wherein the distance between radially adjacent points of said first and second electrodes is uniform.

3. An electric heating apparatus as defined in claim 1, wherein said resistive electrical conductor comprises a plurality of wedge-shaped sections electrically insulated from each other.

4. An electric heating element as defined in claim 1 wherein said electric heating element further comprises a plurality of layers of resistive electrical conductive material separated by an electrical insulator means.

5. An electric heating element as defined in claim 4 wherein each layer comprises a plurality of wedge-shaped sections electrically insulated from each other.

6. An electric heating element as defined in claim 4 in which there are n layers connected in series; the thickness of each layer is 1 nth the thickness of a single-layer element having the same overall dimensions of active material; the effective total resistance of said n layers is proportional to the square of n; said single-layer element having a given wattage; said n-layered heating element having the same wattage as said single-layer element.

7. An electric heating element as defined in claim 3 in which there are m sections of equal resistance connected in series, the effective total resistance of said m-sectioned heating element is proportional to the square of m; said m-segmented electric heating element having the same wattage as a single continuous disc, having the same overall dimensions of active material.

8. An electric heating apparatus, comprising:

a disc-shaped element including a resistive electrical conductor;

said resistive electrical conductor geometrically configured about a central point and having uniform resistivity; said conductor including radial dimensions in a first plane including said central point; said conductor including a varying thickness perpendicular to said first plane; said thickness of said conductor at a given radius from said central point varying inversely with the square of the ratio of said given radius to a reference radius, at a reference point within said radial dimensions of said conductor;

a bore formed in the center of said disc-shaped element;

a first electrically conductive ring electrically connected to said element about the periphery of said bore; and a second electrically conductive ring electrically connected about the periphery of said disc.

9. An electric heating apparatus as defined in claim 8, wherein said disc-shaped element comprises a plurality of wedge-shaped sections electrically insulated from each other.

10. An electric heating apparatus as defined in claim 9 wherein said first electrical conductive ring is divided into segments corresponding with said wedge-shaped sections and said segments are electrically insulated from each other.

11. An apparatus as defined in claim 10 wherein said disc-shaped element comprises two or more of said wedge-shaped sections having a partly circular shape and said segments of said first electrical conductive ring include means to connect said element to a source of electrical power.

12. An electric heating element as defined in claim 10 wherein said second electrical conductive ring is divided into segments corresponding with said wedge-shaped sections and said segments are electrically insulated from each other.

13. An electric heating element as defined in claim 12 further comprising:

means to electrically interconnect predetermined ones of said segments of said first electrically conductive ring;

means to electrically interconnect predetermined ones of said segments of said second electrically conductive ring; and means to apply electrical current across two segments of said first electrical conductive ring, said means to electrically connect said segments of said first electrically conductive ring and said segments of said second electrically conductive ring connected to provide a complete path for current between said segments of said first electrically conductive ring connected to said power source.

14. An electric heating apparatus as defined in claim 8 wherein said disc-shaped element comprises a plurality of layers of resistive electrical conductive material separated by an electrical insulator.

15. An electric heating apparatus as defined in claim 14 further comprising an even number of layers, and means to interconnect in series successive layers at said bore and at said periphery.

16. An electric heating apparatus as defined in claim 15 wherein each layer comprises a plurality of wedge-shaped sections electrically insulated from each other.

17. An electric heating apparatus as defined in claim 16 in which the electric current flow is radial, and in which the rate of conversion of electric into thermal energy is constant over the entire element save for said bore.

18. An electric heating apparatus as defined in claim 15 in which there are m sections of equal resistance connected in series; the effective total resistance of said m-sectioned heating element is proportional to the square of m; said m-sectioned electric heating element having the same wattage as a single continuous disc, with central bore, having the same overall dimensions of active material.

19. An electric heating apparatus as defined in claim 5 or claim 16 in which the effective total resistance of the electric heating element, and hence current and voltage at a given wattage, is determined by varying the number of layers, segments and/or their interconnections.

* * * * *